US010319315B2

(12) United States Patent
Zhang

(10) Patent No.: US 10,319,315 B2
(45) Date of Patent: Jun. 11, 2019

(54) LIQUID CRYSTAL DISPLAY AND A COMPENSATION DATA STORAGE METHOD THEREOF

(71) Applicant: Shenzhen China Star Optoelectronics Technology Co., Ltd., Shenzhen, Guangdong (CN)

(72) Inventor: Hua Zhang, Guangdong (CN)

(73) Assignee: Shenzhen China Star Optoelectronics Technology Co., Ltd, Shenzhen, Guangdong (CN)

( * ) Notice: Subject to any disclaimer, the term of this patent is extended or adjusted under 35 U.S.C. 154(b) by 225 days.

(21) Appl. No.: 15/324,693

(22) PCT Filed: Jan. 5, 2017

(86) PCT No.: PCT/CN2017/070202
§ 371 (c)(1),
(2) Date: Jan. 7, 2017

(87) PCT Pub. No.: WO2018/068433
PCT Pub. Date: Apr. 19, 2018

(65) Prior Publication Data

US 2018/0218693 A1 Aug. 2, 2018

(30) Foreign Application Priority Data

Oct. 10, 2016 (CN) ..... 2016 1 0886169

(51) Int. Cl.
*G09G 3/36* (2006.01)
*G09G 3/00* (2006.01)

(52) U.S. Cl.
CPC ..... *G09G 3/3607* (2013.01); *G09G 3/006* (2013.01); *G09G 3/3648* (2013.01); (Continued)

(58) Field of Classification Search
CPC ..... G09G 3/3406; G09G 3/36; G09G 3/3607; G09G 2320/0233; G09G 2320/0271; G09G 2320/0285
See application file for complete search history.

(56) References Cited

U.S. PATENT DOCUMENTS 7,834,836 B2 * 11/2010 Chung ..... G09G 3/20 345/214
2005/0190195 A1 9/2005 Lindholm et al.
(Continued)

FOREIGN PATENT DOCUMENTS

CN 103489420 A 1/2014
CN 105654891 A 6/2016
(Continued)

*Primary Examiner* — Lixi C Simpson
(74) *Attorney, Agent, or Firm* — Andrew C. Cheng

(57) ABSTRACT

The present disclosure discloses a liquid crystal display and a compensation data storage method thereof, the storage method includes: capturing the target compensation data of the display area; determining the data precision corresponding to the target compensation data according to the data range of the target compensation data; adjusting the target compensation data in accordance with the data precision to obtain the storage compensation data of the data range that can be stored in accordance with the preset storage space; storing the storage compensation data and the data precision. In this manner, the present disclosure can improve the accuracy of the mura compensation data and the data signal can be effectively compensated to reduce the mura condition of the panel.

18 Claims, 4 Drawing Sheets

(52) U.S. Cl.
CPC ..... *G09G 3/3685* (2013.01); *G09G 2310/027* (2013.01); *G09G 2320/0233* (2013.01); *G09G 2320/0276* (2013.01); *G09G 2320/0693* (2013.01)

(56) References Cited

U.S. PATENT DOCUMENTS

| | | | | |
|---|---|---|---|---|
| 2005/0190198 | A1 | 9/2005 | Koyama | |
| 2008/0136846 | A1* | 6/2008 | Abe | G09G 3/3685 345/690 |
| 2008/0174534 | A1* | 7/2008 | Park | G09G 3/3648 345/87 |
| 2015/0356929 | A1* | 12/2015 | Zhan | G09G 3/20 345/690 |
| 2017/0193933 | A1* | 7/2017 | Zhang | G09G 3/36 |
| 2018/0075802 | A1* | 3/2018 | Liu | G09G 3/3233 |

FOREIGN PATENT DOCUMENTS

| | | | |
|---|---|---|---|
| CN | 105913815 | A | 8/2016 |
| CN | 106205546 | A | 12/2016 |
| JP | 19940006733 | | 1/1994 |

* cited by examiner

LIQUID CRYSTAL DISPLAY AND A COMPENSATION DATA STORAGE METHOD THEREOF

FIELD OF THE DISCLOSURE

The present disclosure relates to a display technology field, and more particularly to a liquid crystal display and a compensation data storage method thereof.

BACKGROUND OF THE DISCLOSURE

The uneven abnormal grayscale screen brightness of the each pixel on the LCD panel (mura) can be compensated by the mura compensation data storaged in the flash, the mura compensation data is calculated by the mura compensation system: capturing the mura state of 3 to 5 grayscale screens (different brightness of the white screen) by the camera, and by comparing the brightness of the center of the panel, the required mura compensation data for the surrounding area is calculated, the area that is brighter than the center position decreases a certain grayscale value (storing the corresponding negative value in the flash) and darkens under the current grayscale; the area that is darker than the center position increases a certain grayscale value (storing the corresponding positive value in the flash) and brightens under the current grayscale; and then by the data writier storing the calculated compensation data in the flash, when the panel is working, the timer control register (TCON) will reads the mura compensation data from the flash and displays the mura fixed image brightness is the same after calculated with the input signal (grayscale data).

In the prior art, the mura compensation data calculated by the mura compensation system is composed of the 10 bit integer (0 to 1023 grayscale) and the 3 decimal places, the compensation data will generally be approximated and then stored, so that will make the compensation data and the real value of a certain difference in the data compensation, resulting in display distortion.

SUMMARY OF THE DISCLOSURE

The present disclosure solves the technical problem of providing a liquid crystal display and its compensation data storage method, which can improve the accuracy of mura compensation data and effectively compensate the data signal, thereby reducing the mura condition of the panel.

In order to solve the above technical problem, the disclosure adopts the technical scheme is: provides the compensation data storage method of the LCD, wherein, the method includes: capturing a target compensation data of a display area; if a data range of the target compensation data in a first preset data range, it is determined that a data precision corresponding to the target compensation data is a first data precision, if the data range of the target compensation data over the first preset data range and in a second preset data range, it is determined that the data precision corresponding to the target compensation data is a second data precision, if the data range of the target compensation data over the second preset data range, it is determined that the data precision corresponding to the target compensation data is a third data precision; wherein, the first preset data range is included in the second preset data range, the first data precision is greater than the second data precision, the second data precision is greater than the third data precision; adjusting the target compensation data in accordance with the data precision to obtain a storage compensation data of the data range that can be stored in accordance with a preset storage space; storing the storage compensation data in two-bit hexadecimal numbers and storing the data precision in two-bit binary numbers.

Wherein, the initial data precision of the target compensation data is Nbit, the stored data range of the preset storage space is [A, B]; wherein the data precision corresponding to the target compensation data is determined based on the data range of the target compensation data, including: if the data range of the target compensation data is within [A/4, B/4], it is determined that the data precision corresponding to the target compensation data is (N+2) bit; if the data range of the target compensation data is over [A/4, B/4] and within [A/2, B/2], it is determined that the data precision corresponding to the target compensation data is (N+1) bit; if the data range of the target compensation data is over [A/2, B/2], it is determined that the data precision corresponding to the target compensation data is Nbit.

Wherein, the adjustment of the target compensation data in accordance with the data precision to obtain a storage compensation data of the data range that can be stored in accordance with a preset storage space includes: if the data precision is (N+2) bit, the target compensation data is adjusted to [4a, 4b]; if the data precision is (N+1) bit, the target compensation data is adjusted to [2a, 2b]; if the data precision is Nbit, the target compensation data is adjusted to [a, b]; wherein, [a, b] is the data range of the target compensation data.

Wherein, the initial data precision of the target compensation data is 10 bit, the stored data range of the preset storage space is [−127, 127].

Wherein, reading the stored storage compensation data and the stored data precision, when the LCD displays an image, and restoring the storage compensation data in accordance with the data precision to obtain the target compensation data so as to use the target compensation data compensating a data signal in the display area.

In order to solve the above technical problem, the disclosure adopts another technical scheme is: provides a compensation data storage method of a liquid crystal display, the storage method includes: capturing a target compensation data of a display area; determining a data precision corresponding to the target compensation data according to a data range of the target compensation data; adjusting the target compensation data in accordance with the data precision to obtain a storage compensation data of the data range that can be stored in accordance with a preset storage space; storing the storage compensation data and the data precision.

Wherein the data precision corresponding to the target compensation data is determined based on a data range of the target compensation data, including: if a data range of the target compensation data in a first preset data range, it is determined that a data precision corresponding to the target compensation data is a first data precision; if the data range of the target compensation data over the first preset data range and in a second preset data range, it is determined that the data precision corresponding to the target compensation data is a second data precision; if the data range of the target compensation data over the second preset data range, it is determined that the data precision corresponding to the target compensation data is a third data precision; wherein, the first preset data range is included in the second preset data range; wherein, the first data precision is greater than the second data precision, the second data precision is greater than the third data precision.

Wherein, the initial data precision of the target compensation data is Nbit, the stored data range of the preset storage space is [A, B]; Wherein the data precision corresponding to the target compensation data is determined based on a data range of the target compensation data, including: if the data range of the target compensation data is within [A/4, B/4], it is determined that the data precision corresponding to the target compensation data is (N+2) bit; if the data range of the target compensation data is over [A/4, B/4] and within [A/2, B/2], it is determined that the data precision corresponding to the target compensation data is (N+1) bit; if the data range of the target compensation data is over [A/2, B/2], it is determined that the data precision corresponding to the target compensation data is Nbit.

Wherein, the adjustment of the target compensation data in accordance with the data precision to obtain a storage compensation data of the data range that can be stored in accordance with a preset storage space includes: if the data precision is (N+2) bit, the target compensation data is adjusted to [4a, 4b]; if the data precision is (N+1) bit, the target compensation data is adjusted to [2a, 2b]; if the data precision is Nbit, the target compensation data is adjusted to [a, b]; wherein, [a, b] is the data range of the target compensation data.

Wherein, the initial data precision of the target compensation data is 10 bit, the stored data range of the preset storage space is [−127, 127].

Wherein, the storing the storage compensation data and the data precision, including: storing the storage compensation data in two-bit hexadecimal numbers and storing the data precision in two-bit binary numbers.

Wherein, reading the stored storage compensation data and the stored data precision, when the LCD displays an image, and restoring the storage compensation data in accordance with the data precision to obtain the target compensation data so as to use the target compensation data compensating a data signal in the display area.

In order to solve the above technical problem, the disclosure adopts the other technical scheme is: provides a liquid crystal display, the LCD includes a display panel and a backlight; wherein, the LCD further including a driver is used to capture a target compensation data of a display area; determine a data precision corresponding to the target compensation data based on a data range of the target compensation data; adjust the target compensation data in accordance with the data precision to obtain a storage compensation data of the data range that can be stored in accordance with a preset storage space; the liquid crystal display further includes a memory, the memory is used to store the storage compensation data and the data precision; the driver is further used to read the stored storage compensation data and the stored data precision, when the display panel displays an image, and restore the storage compensation data in accordance with the data precision to obtain the target compensation data so as to use the target compensation data compensating a data signal in the display area.

Wherein, the initial data precision of the target compensation data is Nbit, the stored data range of the preset storage space is [A, B]; the driver is further used to: determine the data precision corresponding to the target compensation data is (N+2) bit, when the data range of the target compensation data is within [A/4, B/4]; determine the data precision corresponding to the target compensation data is (N+1) bit, when the data range of the target compensation data is over [A/4, B/4] and within [A/2, B/2]; determine the data precision corresponding to the target compensation data is Nbit, when the data range of the target compensation data is over [A/2, B/2].

Wherein, the driver is further used to: adjust the target compensation data to [4a, 4b], when the data precision is (N+2) bit; adjust the target compensation data to [2a, 2b], when the data precision is (N+1) bit; adjust the target compensation data to [a, b], when the data precision is Nbit; wherein, the [a, b] is the data range of the target compensation data.

Wherein, the initial data precision of the target compensation data is 10 bit, the stored data range of the preset storage space is [−127, 127].

Wherein, the memory is specifically used to store the storage compensation data in two-bit hexadecimal numbers and store the data precision in two-bit binary numbers.

Wherein, the driver is further used to: read the storage compensation data and the data precision in the memory, when the liquid crystal display displays an image, and restore the storage compensation data in accordance with the data precision to obtain the target compensation data so as to use the target compensation data compensating a data signal in the display area.

The disclosure has the advantages that: different from the state of the prior art, the compensation data storage method of the LCD of the present disclosure includes: capturing the target compensation data of the display area; determining the data precision corresponding to the target compensation data according to the data range of the target compensation data; adjusting the target compensation data in accordance with the data precision to obtain the storage compensation data of the data range that can be stored in accordance with the preset storage space; storing the storage compensation data and the data precision. In this manner, the compensation data is stored with an unused precision according to the range of the compensation data, and the accuracy of the mura compensation data can be improved and the data signal can be effectively compensated to reduce the mura condition of the panel.

DETAILED DESCRIPTION OF PREFERRED EMBODIMENTS

Figure 1:
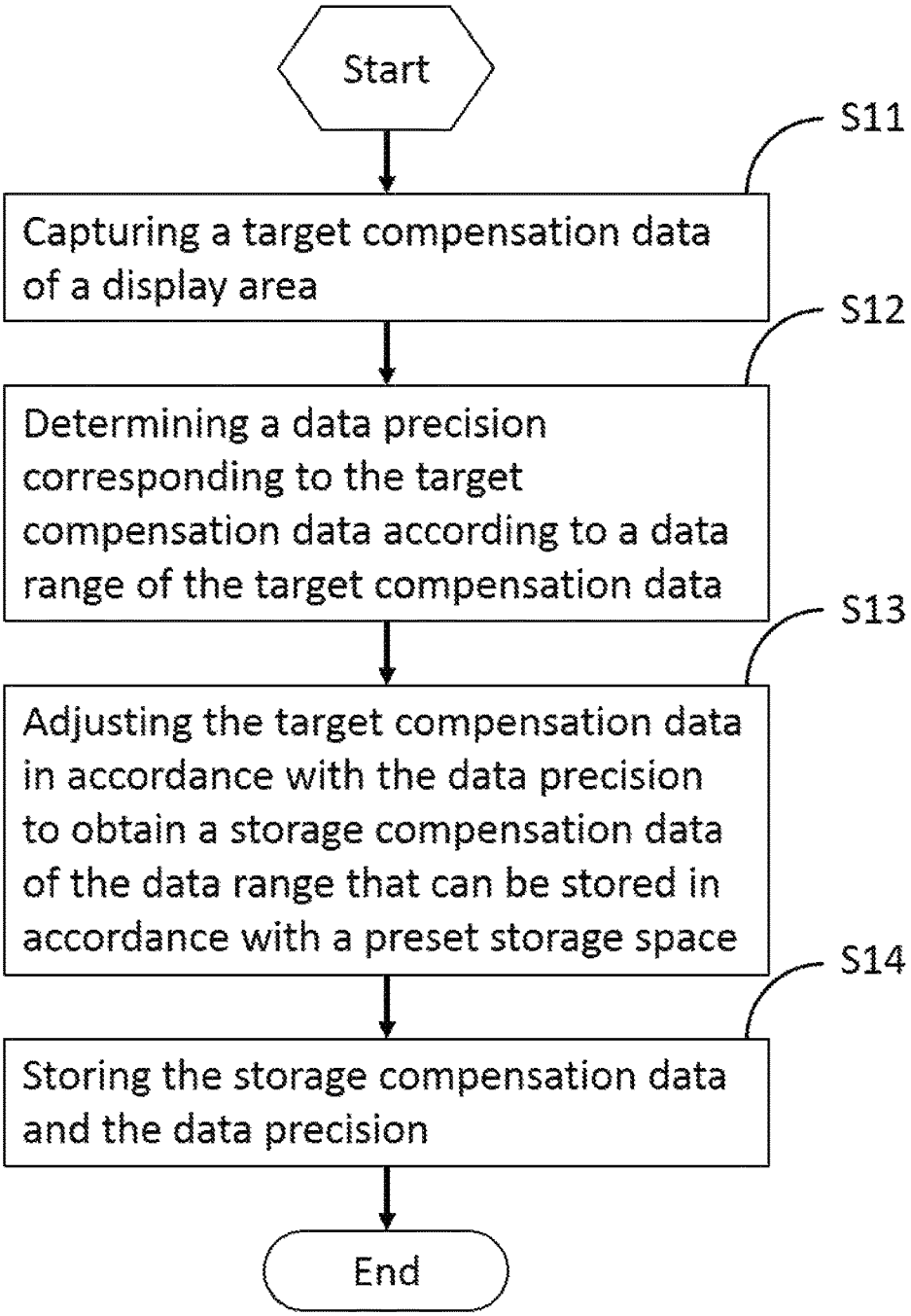
FIG. 1 is a flow chart of one embodiment of the compensation storage method of the LCD of the present disclosure.

Refer to FIG. 1, FIG. 1 is a flow chart of one embodiment of the compensation storage method of the LCD of the present disclosure, the method includes:

S11: capturing the target compensation data of the display area.

The mura compensation data of the display area is calculated by the mura compensation system: capturing the mura state of 3 to 5 grayscale screens (different brightness of the white screen) by the camera, and by comparing the brightness of the center of the panel, the required mura compensation data for the surrounding area is calculated, the area that is brighter than the center position decreases a certain grayscale value (storing the corresponding negative value in the flash) and darkens under the current grayscale; the area that is darker than the center position increases a certain grayscale value (storing the corresponding positive value in the flash) and brightens under the current grayscale; and then by the data writer storing the calculated compensation data in the flash, when the panel is working, the timer control register (TCON) will reads the mura compensation data from the flash and displays the mura fixed image brightness is the same after calculated with the input signal (grayscale data).

Figure 2:
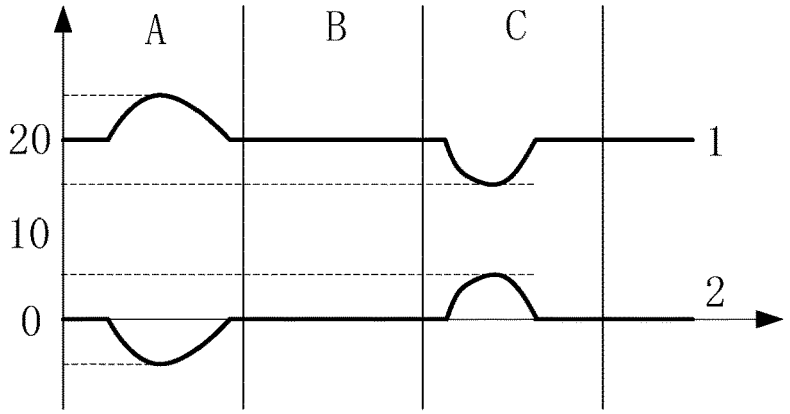
FIG. 2 is a schematic of the data signal and the compensation signal of the first embodiment of the compensation storage method of the LCD of the present disclosure.

Specifically shown in FIG. 2, the cross-left indicates the display area (where A, B and C denote adjacent three pixels), the ordinate indicates the grayscale value. Wherein, look at the curve 1 first (raw data curve), the B pixel is intermediate pixel, the grayscale value is 20, while the A pixel grayscale value is too high, the C pixel grayscale value is too low. The curve 1 can be compensated through the curve 2 (compensation data curve) to obtain the data signal with the grayscale value is 20.

In practice, the compensation data is stored in the flash, the flash capacity is limited, resulting in the stored data range is limited, when the data range of the compensation data is large, it cannot be directly stored.

S12: determining the data precision corresponding to the target compensation data according to the data range of the target compensation data.

Understandably, the compensation data of the LCD is actually the compensation of the grayscale value, the grayscale value according to different segments can have different accuracy. For example, in the case of 50% grayscale, in the 256 grayscale precision (0-255 grayscale), 50% grayscale is 127 grayscale value, in the 1024 grayscale precision (0-1023), 50% grayscale is 511 grayscale value.

Understandably, the target compensation data is generally a high-precision gray-scale value, but because the preset storage space has a certain storage range, the target compensation data need to be rounded, and then stored, which will make the target compensation data distortion.

In the present embodiment, according to the data range of the target compensation data, the target compensation data is adjusted by the corresponding precision, and then stored. For example, in the 10 bit precision (i.e. 0-1023 grayscale value), the target compensation data is 25.2, if stored directly, is stored rounding to 25, if change the precision to 12 bit precision (i.e. 0-4095 grayscale value), the target compensation data becomes 25.2*4, i.e. 100.8, and then take the whole is 101. When reading this grayscale value, 101/4=25.25. As can be seen, 25.25 is closer to 25.2 than 25.

Optionally, in an embodiment, S12 may specifically include:

if a data range of the target compensation data in a first preset data range, it is determined that a data precision corresponding to the target compensation data is a first data precision;

if the data range of the target compensation data over the first preset data range and in a second preset data range, it is determined that the data precision corresponding to the target compensation data is a second data precision;

if the data range of the target compensation data over the second preset data range, it is determined that the data precision corresponding to the target compensation data is a third data precision.

Wherein, the first preset data range is included in the second preset data range; wherein, the first data precision is greater than the second data precision, the second data precision is greater than the third data precision.

Understandably, the preset storage space has a certain data storage range, therefore, when adjusting the precision of the target data, it is necessary to take into account that the target data should not exceed the storage range of the preset space after adjustment of the target data.

Optionally, in a particular embodiment, the initial data precision of the target compensation data is Nbit, the store data range of the preset storage space is [A, B]. The S12 may specifically include:

if the data range of the target compensation data is within [A/4, B/4], it is determined that the data precision corresponding to the target compensation data is (N+2) bit;

if the data range of the target compensation data is over [A/4, B/4] and within [A/2, B/2], it is determined that the data precision corresponding to the target compensation data is (N+1) bit;

if the data range of the target compensation data is over [A/2, B/2], it is determined that the data precision corresponding to the target compensation data is Nbit.

S13: adjusting the target compensation data in accordance with the data precision to obtain the storage compensation data of the data range that can be stored in accordance with the preset storage space.

Referring to the specific embodiment in S12 above, S13 may specifically include:

if the data precision is (N+2) bit, the target compensation data is adjusted to [4a, 4b];

if the data precision is (N+1) bit, the target compensation data is adjusted to [2a, 2b];

if the data precision is Nbit, the target compensation data is adjusted to [a, b];

wherein, [a, b] is the data range of the target compensation data.

S14: storing the storage compensation data and the data precision.

Wherein, in one embodiment, S14 may specifically be: storing the storage compensation data in two-bit hexadecimal numbers and storing the data precision in two-bit binary numbers.

Optionally, after S14, further includes: reading the stored storage compensation data and the stored data precision, when the LCD displays an image, and restoring the storage compensation data in accordance with the data precision to obtain the target compensation data so as to use the target compensation data compensating a data signal in the display area.

Hereinafter, the present embodiment will be described with reference to a specific example:

In general, the mura compensation data calculated by the mura compensation system is composed of the 10 bit integer (0 to 1023 grayscale) and the 3 decimal places, the precision is very high, in order to save the storage space of the mura compensation data, the individual mura compensation data is stored by the two-bit hexadecimal integer (00-FF, FF=11111111) in flash (flash memory, i.e. the default storage space), since the mura compensation data has positive and negative values, the most significant bit needs to be used as the sign bit (can be 0 is positive, 1 is negative), then two hexadecimal data can actually represent the mura compensation data range is −127~+127 decimal grayscale (FF=11111111=−127, EF=01111111=+127).

Figure 3:
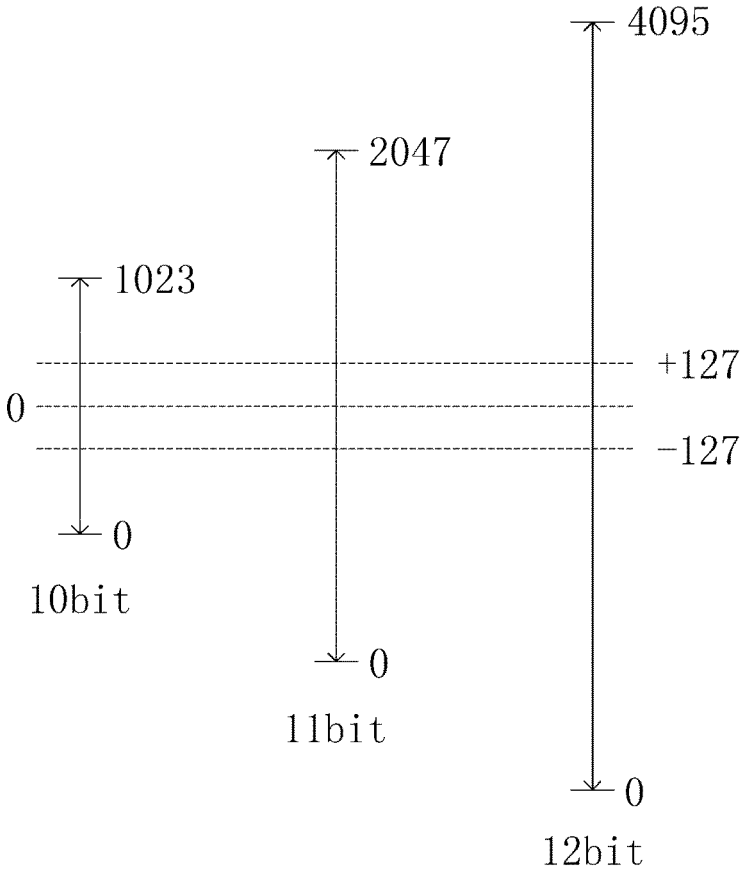
FIG. 3 is a schematic of the data range and the precision in one embodiment of the compensation storage method of the LCD of the present disclosure.

As shown in FIG. 3, the limit of the storage range of the mura compensation data in the flash is −127~+127 (integer), in the 10 bit compensation precision, the compensation data range is 24.90% of total grayscale (0~1023), in the 11 bit compensation precision, the compensation data range is 12.45% of total grayscale (0~2047), in the 12 bit compensation precision, the compensation data range is 6.23% of total grayscale (0~4095); i.e. the compensation precision is higher, the proportion of the compensation data range is smaller.

Figure 4:
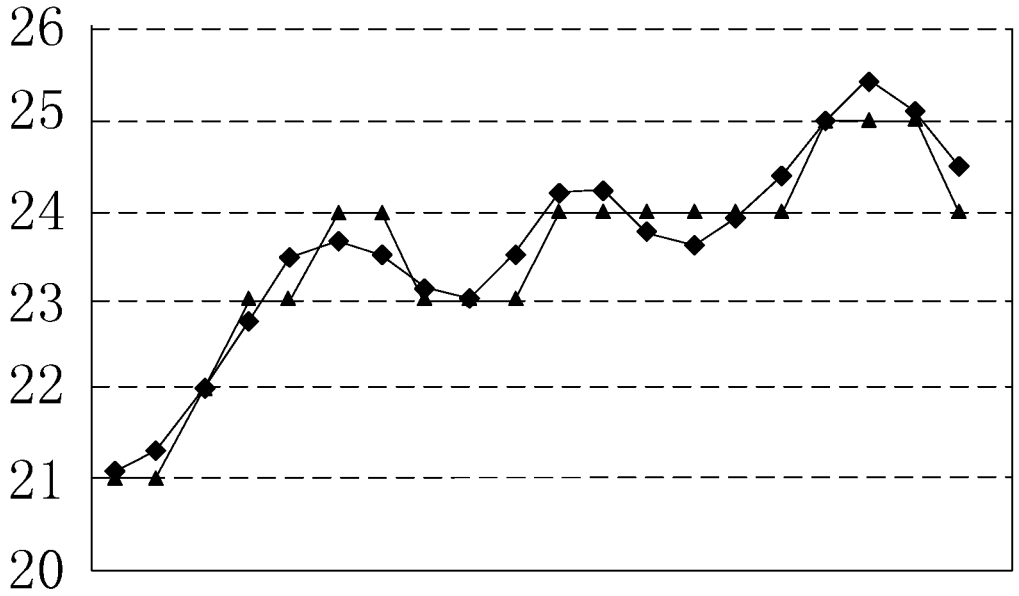
FIG. 4 is a fitting schematic of the raw curve and adjust curve in the 10 bit precision in one embodiment of the compensation storage method of the LCD of the present disclosure.
Figure 5:
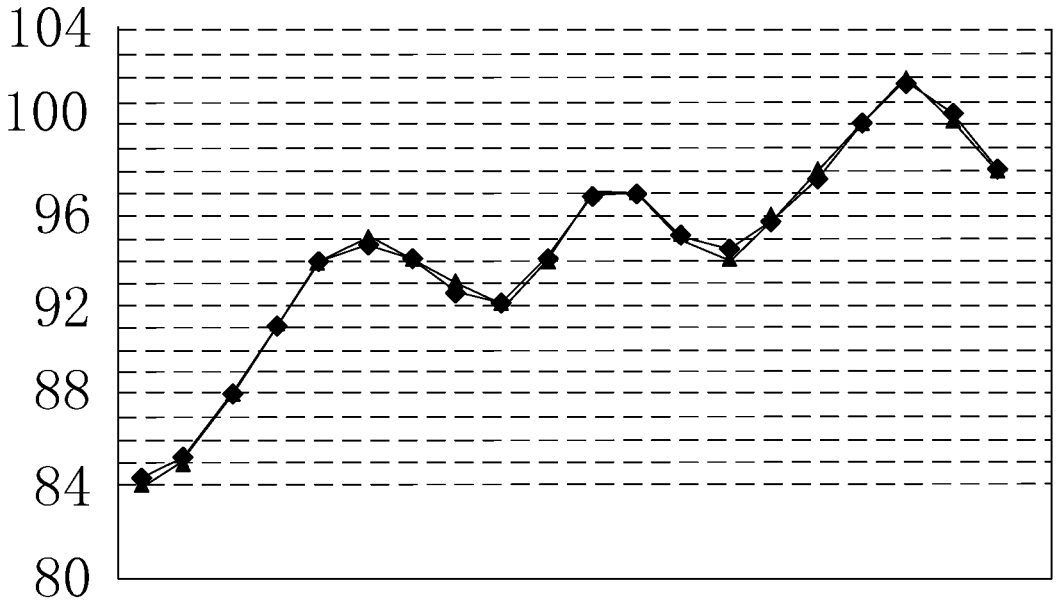
FIG. 5 is a fitting schematic of the raw curve and adjust curve in the 12 bit precision in one embodiment of the compensation storage method of the LCD of the present disclosure.

Referring again to FIG. 4, select the part mura compensation data of a piece of panel, the small square represents the original mura compensation data, since the decimal part has 3 decimal places, the different between adjacent data is small, two straight lines (TCON internal linear interpolation algorithm) connected to get a relatively smooth curve; as the flash cannot save the decimal value, when 10 bit compensation precision is used, the fractional part is rounded off, mura compensation data moved to the triangle position, the difference between adjacent data becomes larger, with a straight line after two connections to get the curve, you can see the two curves fit is not very good, although the trend remained basically the same, but some subtle (for example, the high and low turning point) is quite different, after the TCON IC compensating, there will still be a small brightness deviation;

referring again to FIG. 5, The same raw mura compensation data, when using 12 bit compensation precision, the fractional part multiplied by 4 times and then rounded, effectively retains the fractional part of the value, for example: the raw mura compensation data is 20.235, in the 10 bit compensation precision, to fractional part is rounded to 20, while in the 12 bit compensation precision, 20.235*4=80.94, the stored value is rounded to 81, which is equivalent to 10 bit compensation precision of 81/4=20.25, with the raw mura compensation data closer, so in the 12 bit compensation precision, you can see the raw mura compensation data (also multiplied by 4 times) curve and 12 bit compensation precision of the data curve is very high degree of fit, not only on the trend to maintain the same, the slight difference is very small, after the TCON IC compensating, the brightness deviation after compensating is small.

Thus, a specific scheme is given below:

the mura compensation system obtains 10 bit raw mura compensation data according to the mura status of the panel, and according to the relationship of the maximum/minimum value and the flash storage limit [−127, +127], select the most appropriate compensation precision. Specifically, if the overall range of the raw mura compensation data is −31.75 to +31.75, the optimum 12 bit compensation precision is selected, if the overall of the raw mura compensation data is −63.5 to +63.5, the optimum 11 bit compensation precision, if the overall range of the raw mura compensation data is over −63.5/+63.5, the optimum 10 bit compensation precision.

Wherein, the 10/11/12 bit precision can be represented by two-bit binary data and stored in the flash, For example, with 00 said 10 bit precision, 01 said 11 bit precision, 10 said 12 bit precision, the mura compensation data according to the selected compensation precision for the corresponding treatment and then stored in the flash; the TCON IC reads the compensation precision in the flash and the corresponding mura compensation data to complete the corresponding mura compensation; so that each panel according to the actual mura situation, can automatically select the best mura compensation precision and compensation effects.

Different from the prior art, the present disclosure relates to a compensation data storage method for the liquid crystal display including: capturing the target compensation data of the display area; determining the data precision corresponding to the target compensation data based on the data range of the target compensation data; adjusting the target compensation data in accordance with the data precision to obtain the storage compensation data of the data range that can be stored in accordance with the preset storage space; storing the storage compensation data and the data precision. In this manner, the compensation data is stored with an unused precision according to the range of the compensation data, and the accuracy of the mura compensation data can be improved and the data signal can be effectively compensated to reduce the mura condition of the panel.

Figure 6:
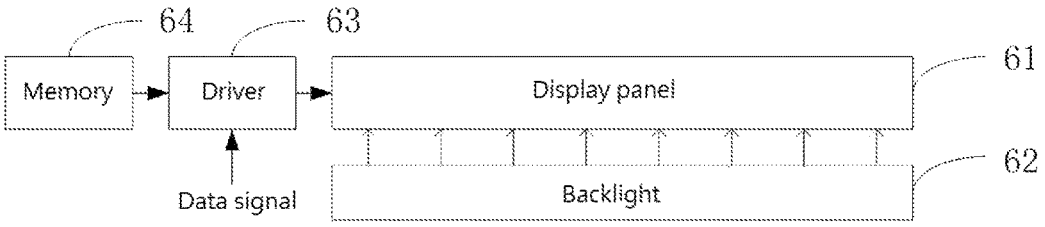
FIG. 6 is a structure diagram of one embodiment of the LCD of the present disclosure.

Refer to FIG. 6, FIG. 6 is a structure diagram of one embodiment of the LCD of the present disclosure, the LCD includes the display panel 61 and the backlight 62.

Wherein, the LCD further includes the driver 63, the driver 63 is used to:

capture a target compensation data of a display area; determine a data precision corresponding to the target compensation data based on a data range of the target compensation data; adjust the target compensation data in accordance with the data precision to obtain a storage compensation data of the data range that can be stored in accordance with a preset storage space.

The liquid crystal display further includes a memory 64, the memory 64 is used to store the storage compensation data and the data precision.

The driver 63 is further used to read the stored storage compensation data and the stored data precision, when the display panel displays an image, and restore the storage compensation data in accordance with the data precision to obtain the target compensation data so as to use the target compensation data compensating a data signal in the display area.

Optionally, in the other embodiment, the initial data precision of the target compensation data is Nbit, the stored data range of the preset storage space is [A, B].

The driver 63 is further used to:

determine the data precision corresponding to the target compensation data is (N+2) bit, when the data range of the target compensation data is within [A/4, B/4];

determine the data precision corresponding to the target compensation data is (N+1) bit, when the data range of the target compensation data is over [A/4, B/4] and within [A/2, B/2];

determine the data precision corresponding to the target compensation data is Nbit, when the data range of the target compensation data is over [A/2, B/2].

The driver 63 is further used to:

adjust the target compensation data to [4a, 4b], when the data precision is (N+2) bit;

adjust the target compensation data to [2a, 2b], when the data precision is (N+1) bit;

adjust the target compensation data to [a, b], when the data precision is Nbit;

wherein, the [a, b] is the data range of the target compensation data.

Figure 7:
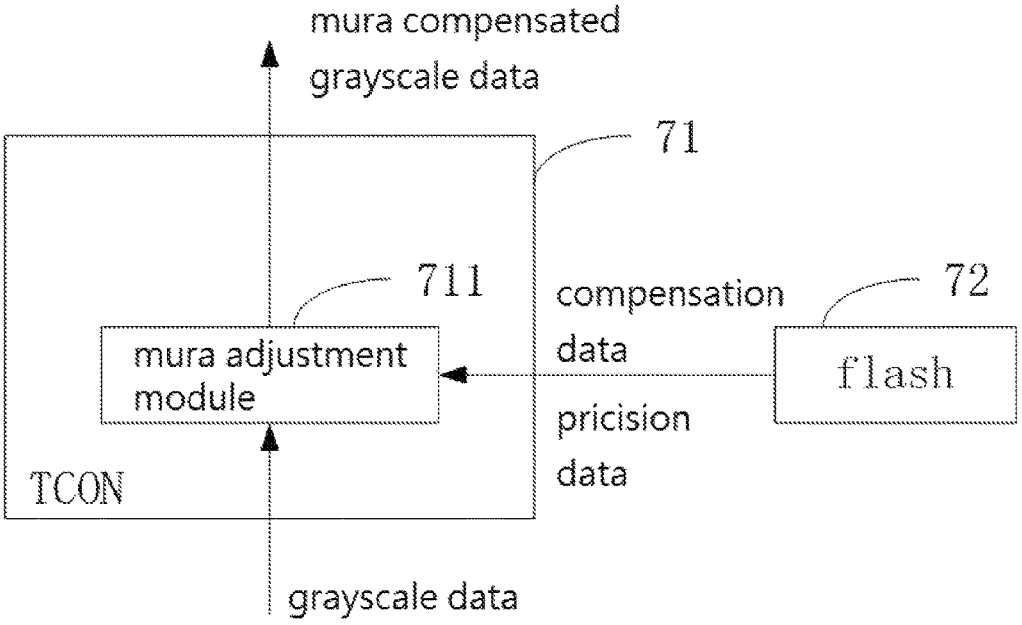
FIG. 7 is a structure connection diagram of the TCON and flash in one embodiment of the LCD of the present disclosure.

Optionally, as shown in FIG. 7, in an embodiment, the driver 63 is TCON (71), the memory 64 is flash (72).

Wherein, the TCON (71) at least includes the mura adjustment module 711, the mura adjust module 711 is used to capture the grayscale data and read the compensation data and precision data in the flash, use the precision data to restore the stored compensation data to the raw compensation data first, and then use the raw compensation data to compensate the grayscale data, the final output the compensated grayscale data.

The above are only embodiments of the present disclosure is not patented and therefore limit the scope of the present disclosure, the use of any content of the present specification and drawings made equivalent or equivalent structural transformation process, either directly or indirectly in other relevant technical fields are included in the same way the scope of patent protection of the present disclosure.

What is claimed is:

1. A compensation data storage method of a liquid crystal display, wherein, the method comprises:

capturing a target compensation data of a display area;

based on a data range of the target compensation data that is in a first preset data range, it is determined that a data precision corresponding to the target compensation data is a first data precision, based on the data range of the target compensation data that is over the first preset data range and in a second preset data range, it is determined that the data precision corresponding to the target compensation data is a second data precision, based on the data range of the target compensation data that is over the second preset data range, it is determined that the data precision corresponding to the target compensation data is a third data precision; wherein, the first preset data range is included in the second preset data range, the first data precision is greater than the second data precision, the second data precision is greater than the third data precision;

adjusting the target compensation data in accordance with the data precision to obtain a storage compensation data of the data range that can be stored in accordance with a preset storage space;

storing the storage compensation data in two-bit hexadecimal numbers and storing the data precision in two-bit binary numbers.

2. The storage method according to claim 1, wherein, an initial data precision of the target compensation data is Nbit, the stored data range of the preset storage space is [A, B];

wherein the data precision corresponding to the target compensation data is determined based on the data range of the target compensation data, comprising:

based on the data range of the target compensation data of within [A/4, B/4], it is determined that the data precision corresponding to the target compensation data is (N+2) bit;

based on the data range of the target compensation data of over [A/4, B/4] and within [A/2, B/2], it is determined that the data precision corresponding to the target compensation data is (N+1) bit;

based on the data range of the target compensation data of over [A/2, B/2], it is determined that the data precision corresponding to the target compensation data is Nbit.

3. The storage method according to claim 2, wherein, the adjustment of the target compensation data in accordance with the data precision to obtain a storage compensation data of the data range that can be stored in accordance with a preset storage space comprises:

based on the data precision of (N+2) bit, the target compensation data is adjusted to [4a, 4b];

based on the data precision of (N+1) bit, the target compensation data is adjusted to [2a, 2b];

based on the data precision of Nbit, the target compensation data is adjusted to [a, b];

wherein, [a, b] is the data range of the target compensation data.

4. The storage method according to claim 3, wherein, the initial data precision of the target compensation data is 10 bit, the stored data range of the preset storage space is [−127, 127].

5. The storage method according to claim 1, wherein, reading the stored storage compensation data and the stored data precision, when the LCD displays an image, and restoring the storage compensation data in accordance with the data precision to obtain the target compensation data so as to use the target compensation data compensating a data signal in the display area.

6. A compensation data storage method of a liquid crystal display, wherein, the method comprises:

capturing a target compensation data of a display area;

determining a data precision corresponding to the target compensation data according to a data range of the target compensation data;

adjusting the target compensation data in accordance with the data precision to obtain a storage compensation data of the data range that can be stored in accordance with a preset storage space;

storing the storage compensation data and the data precision.

7. The storage method according to claim 6, wherein the data precision corresponding to the target compensation data is determined based on a data range of the target compensation data, comprising:

based on a data range of the target compensation data that is in a first preset data range, it is determined that a data precision corresponding to the target compensation data is a first data precision;

based on the data range of the target compensation data that is over the first preset data range and in a second preset data range, it is determined that the data precision corresponding to the target compensation data is a second data precision;

based on the data range of the target compensation data that is over the second preset data range, it is determined that the data precision corresponding to the target compensation data is a third data precision;

wherein, the first preset data range is included in the second preset data range;

wherein, the first data precision is greater than the second data precision, the second data precision is greater than the third data precision.

8. The storage method according to claim 7, wherein, an initial data precision of the target compensation data is Nbit, the stored data range of the preset storage space is [A, B];

wherein the data precision corresponding to the target compensation data is determined based on a data range of the target compensation data, comprising:

based on the data range of the target compensation data of within [A/4, B/4], it is determined that the data precision corresponding to the target compensation data is (N+2) bit;

based on the data range of the target compensation data of over [A/4, B/4] and within [A/2, B/2], it is determined that the data precision corresponding to the target compensation data is (N+1) bit;

based on the data range of the target compensation data of over [A/2, B/2], it is determined that the data precision corresponding to the target compensation data is Nbit.

9. The storage method according to claim 8, wherein, the adjustment of the target compensation data in accordance with the data precision to obtain a storage compensation data of the data range that can be stored in accordance with a preset storage space comprises:

based on the data precision of (N+2) bit, the target compensation data is adjusted to [4a, 4b];

based on the data precision of (N+1) bit, the target compensation data is adjusted to [2a, 2b];

based on the data precision of Nbit, the target compensation data is adjusted to [a, b];

wherein, [a, b] is the data range of the target compensation data.

10. The storage method according to claim 6, wherein, an initial data precision of the target compensation data is 10 bit, the stored data range of the preset storage space is [−127, 127].

11. The storage method according to claim 6, wherein, the storing the storage compensation data and the data precision, comprising:

storing the storage compensation data in two-bit hexadecimal numbers and storing the data precision in two-bit binary numbers.

12. The storage method according to claim 6, wherein, reading the stored storage compensation data and the stored data precision, when the LCD displays an image, and restoring the storage compensation data in accordance with the data precision to obtain the target compensation data so as to use the target compensation data compensating a data signal in the display area.

13. A liquid crystal display, wherein, the liquid crystal display comprises a display panel and a backlight;

wherein, the liquid crystal display further comprises a driver, the driver is used to:

capture a target compensation data of a display area;

determine a data precision corresponding to the target compensation data based on a data range of the target compensation data;

adjust the target compensation data in accordance with the data precision to obtain a storage compensation data of the data range that can be stored in accordance with a preset storage space;

the liquid crystal display further comprises a memory, the memory is used to store the storage compensation data and the data precision;

the driver is further used to read the stored storage compensation data and the stored data precision, when the display panel displays an image, and restore the storage compensation data in accordance with the data precision to obtain the target compensation data so as to use the target compensation data compensating a data signal in the display area.

14. The liquid crystal display according to claim 13, wherein, an initial data precision of the target compensation data is Nbit, the stored data range of the preset storage space is [A, B];

the driver is further used to:

determine the data precision corresponding to the target compensation data is (N+2) bit, when the data range of the target compensation data is within [A/4, B/4];

determine the data precision corresponding to the target compensation data is (N+1) bit, when the data range of the target compensation data is over [A/4, B/4] and within [A/2, B/2];

determine the data precision corresponding to the target compensation data is Nbit, when the data range of the target compensation data is over [A/2, B/2].

15. The liquid crystal display according to claim 14, wherein, the driver is further used to:

adjust the target compensation data to [4a, 4b], when the data precision is (N+2) bit;

adjust the target compensation data to [2a, 2b], when the data precision is (N+1) bit;

adjust the target compensation data to [a, b], when the data precision is Nbit;

wherein, the [a, b] is the data range of the target compensation data.

16. The liquid crystal display according to claim 15, wherein, the initial data precision of the target compensation data is 10 bit, the stored data range of the preset storage space is [−127, 127].

17. The liquid crystal display according to claim 13, wherein, the memory is specifically used to store the storage compensation data in two-bit hexadecimal numbers and store the data precision in two-bit binary numbers.

18. The liquid crystal display according to claim 13, wherein, the driver is further used to: read the storage compensation data and the data precision in the memory, when the liquid crystal display displays an image, and restore the storage compensation data in accordance with the data precision to obtain the target compensation data so as to use the target compensation data compensating a data signal in the display area.

* * * * *